US007138043B2

(12) United States Patent
Meyer et al.

(10) Patent No.: US 7,138,043 B2
(45) Date of Patent: Nov. 21, 2006

(54) METHOD FOR APPLYING A METAL LAYER TO A LIGHT METAL SURFACE

(75) Inventors: Heinrich Meyer, Berlin (DE); Mathias Wunsche, Zepernick (DE)

(73) Assignee: Atotech Deutschland GmbH, Berlin (DE)

( * ) Notice: Subject to any disclaimer, the term of this patent is extended or adjusted under 35 U.S.C. 154(b) by 507 days.

(21) Appl. No.: 10/220,939

(22) PCT Filed: Mar. 7, 2001

(86) PCT No.: PCT/DE01/00944

§ 371 (c)(1),
(2), (4) Date: Nov. 13, 2002

(87) PCT Pub. No.: WO01/66830

PCT Pub. Date: Sep. 13, 2001

(65) Prior Publication Data

US 2003/0116442 A1 Jun. 26, 2003

(30) Foreign Application Priority Data

Mar. 9, 2000 (DE) ..... 100 13 298

(51) Int. Cl.
*C25D 3/56* (2006.01)
*C25D 3/20* (2006.01)

(52) U.S. Cl. ..... 205/255; 205/256; 205/258; 205/270

(58) Field of Classification Search ..... 205/255, 205/256, 258, 270
See application file for complete search history.

(56) References Cited

U.S. PATENT DOCUMENTS

| | | | | |
|---|---|---|---|---|
| 1,945,107 | A * | 1/1934 | Cain | 205/270 |
| 3,086,927 | A * | 4/1963 | Chessin et al. | 205/258 |
| 4,101,389 | A | 7/1978 | Uedaira | 204/44 |
| 4,533,441 | A | 8/1985 | Gamblin | 204/3 |
| 4,629,659 | A | 12/1986 | Kyono et al. | 428/659 |
| 4,746,412 | A | 5/1988 | Uchida et al. | 204/44.7 |
| 4,765,872 | A * | 8/1988 | Hamano et al. | 205/101 |
| 5,369,719 | A | 11/1994 | Troup-Packman | 205/213 |
| 6,036,742 | A | 3/2000 | Leutner et al. | 75/349 |

FOREIGN PATENT DOCUMENTS

DE 196 53 210 A1 6/1997

(Continued)

OTHER PUBLICATIONS

Horn, "Pulse Plating", Dynatronix, Aug. 5, 1999, pp. 1-13.*

*Primary Examiner*—Edna Wong
(74) *Attorney, Agent, or Firm*—Frank J. Bonini, Jr.; John F. A. Earley, III; Harding, Earley, Follmer & Frailey

(57) ABSTRACT

A process for applying a metal layer to surfaces of light metals is proposed, in which iron is electrolytically deposited on the surfaces from a deposition bath containing Fe(II) compounds using dimensionally stable anodes insoluble in the deposition bath. The process is especially suitable for coating cylinder faces of internal combustion engines and of rotationally symmetrical parts with layers having very high wear resistance, especially of valves, nozzles and other parts of high-pressure injection systems for motor vehicle engines. In addition, the present invention pertains to nanocrystalline iron-phosphorus layers, which can be formed preferably by depositing iron in the presence of compounds containing orthophosphite and/or hypophosphite. These layers also have good corrosion resistance besides the good wear resistance.

18 Claims, 1 Drawing Sheet

FOREIGN PATENT DOCUMENTS

Figure 1:
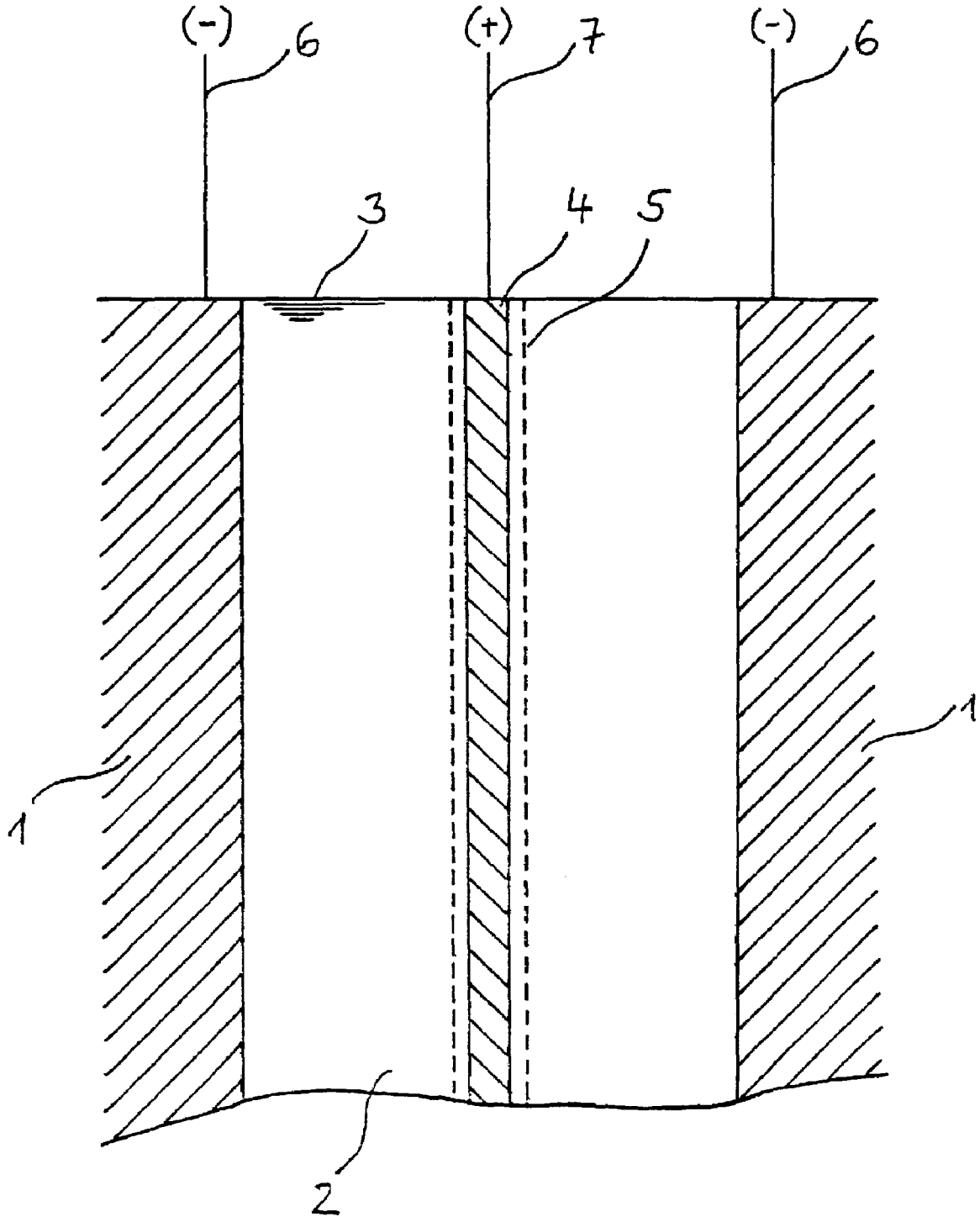

| | | | |
|---|---|---|---|
| EP | 0 624 662 | A1 | 11/1994 |
| EP | 0 861 699 | A1 | 9/1998 |
| GB | 2308387 | A | 6/1997 |
| GB | 2308387 | B | 6/1997 |
| JP | 2-70068 | | 3/1990 |

* cited by examiner

METHOD FOR APPLYING A METAL LAYER TO A LIGHT METAL SURFACE

BACKGROUND OF THE INVENTION

1. Field of the Invention

The present invention pertains to a process for applying a metal layer to surfaces of light metals, especially to surfaces of aluminum, magnesium and their alloys, to applications of the process for coating cylinder faces of internal combustion engines and rotationally symmetrical parts with layers having very high wear resistance, especially of valves, nozzles and other parts of high-pressure injection systems for motor vehicle engines as well as to a nanocrystalline iron-phosphorus layer.

2. Brief Description of the Related Art

In coating light metals, especially aluminum, magnesium and their alloys, considerable efforts were made in the past to optimize the desired surface properties of these metals for the applications being considered. These metals are relatively soft and have, in general, only insufficient tribological and corrosion properties, so that their fields of use are very limited without additional precipitation hardening of the surface, unless special and correspondingly expensive alloys, e.g., supereutectic AlSi, are used. There has been great interest for some time especially in the automotive industry in using light metals to reduce weight in order to reduce the fuel consumption. For example, engine blocks are manufactured from this material. The cylinder faces, in particular, now require special measures to meet the specifications. It was therefore necessary to find processes for improving the surface with which the desired properties can be obtained.

W. Paatsch reported in this connection in *Metalloberfläche*, Vol. 51 (1997), pp. 678–682, that the surface of aluminum materials can be improved in a suitable manner with nickel-phosphorus layers and nickel layers applied by electroplating, in which hard materials are embedded as a dispersion in the layer, e.g., with silicon carbide as the dispersed material, so that the surface properties of the light metal meet the requirements imposed on cylinder faces in internal combustion engines. These layers partly confer good corrosion resistance and a high degree of protection against wear on the surfaces. As an alternative, good wear properties can also be obtained with hard chromium layers on the light metal surfaces, optionally aftertreated according to a plasma nitriding process. As an alternative, it is also possible to use thermal spraying processes, e.g., the powder or wire spraying process. To reach a sufficient adhesive strength on the cylinder faces of the layers deposited according to these processes, the energy of the particles sprayed on must be as high as possible. Detonation spraying and the HVOF (High Velocity Oxygen Fuel) technique are therefore used. For example, tungsten carbide particles can be applied to the surfaces in a metal matrix, e.g., in a cobalt or cobalt-chromium layer, so that a very strongly adhering and especially particularly corrosion-resistant layer is formed. Tungsten carbide layers that have very good tribological properties can also be prepared by plasma spraying.

However, depending on the process according to which they were prepared, the said layers have various drawbacks: On the one hand, the preparation of these layers is extremely complicated and therefore expensive, so that they are not suitable for mass application, as in the automotive industry (especially detonation spraying and the HVOF technique). The described nickel-phosphorus layers deposited by electroplating lack sufficiently good tribological properties. This also applies to the above-mentioned silicon carbide dispersion layers. The latter have not proved successful as coatings for cylinder faces, because the emergency running properties of the engine, i.e., the ability of the engine to withstand a transient separation of the oil film on the faces without damage, were not satisfactory in this case. This was due to the unsatisfactory corrosion resistance of the layers at excessively low oil temperatures over a long time and/or to unsatisfactory resistance to fuels with high sulfur content and to the insufficient wear properties that are associated herewith.

An alternative coating system is described in DE 196 53 210 A1. These are corrosion-resistant iron layers that contain 0.02 wt. % to 0.5 wt. % of nitrogen. It is stated that these layers can be deposited on aluminum or its alloys by electroplating. The coating of the inner sides of aluminum cylinders of internal combustion engines are given as examples of the application of such layers. A deposition bath containing iron(II) ions is used to deposit the layers, and the layer is deposited electrolytically using an anode consisting of iron or preferably using an insoluble anode, which consists of a titanium plate having a film consisting of an oxide of ruthenium, iridium, tantalum, tungsten, rhodium, cobalt or manganese.

Another coating method is described in U.S. Pat. No. 5,368,719. Iron layers are deposited in this case according to electroplating processes on pistons of internal combustion engines, the pistons consisting of aluminum or its alloys. A bath containing iron(II) sulfate is used for this purpose. Graphite, lead, platinum and titanium are used as materials for the anodes.

U.S. Pat. No. 4,746,412 discloses a bath for depositing iron-phosphorus alloy layers. Such baths contain iron(II) ions, hypophosphorous acid, a hypophosphite, phosphorous acid or an orthophosphite and optionally boric acid or aluminum chloride. The layers obtained have a phosphorus content of 0.1 wt. % to 9.9 wt. %. The layers are applied, e.g., on the inner walls of pistons of internal combustion engines. According to the data contained in this document, the layers possess good tribological properties.

In many cases, the suitability of the baths used for the deposition for use in industrial processes is not satisfactory in mass production despite the great advances made in this area. For example, functional layers of uniform thickness must be able to be deposited with little effort on the inner walls of the cylinders, and the reproducibility and the constancy of the desired layer thickness is of particular significance as well. The adhesive strength of the functional layers applied to the light metal surfaces also fails to meet the specifications in all cases. This applies especially to the layers applied according to the plasma spraying method. Furthermore, the problem that the constancy of the conditions required for a qualitatively satisfactory mass production can be achieved during the process only with considerable efforts is encountered with the use of electroplating processes for depositing iron layers as well. Despite comprehensive monitoring and control methods for conducting the process, it has not yet become possible to guarantee a fine setting for the lasting constancy of the process parameters, so that it is not possible to eliminate variations in the quality of the deposited layers without problems. The documents mentioned contain no references to these problems and to their solution.

SUMMARY OF THE INVENTION

The basic object of the present invention is therefore to avoid the drawbacks of the prior-art coating processes and especially to find a process with which functional layers that meets, on the one hand, the desired specifications with respect to the wear properties necessary for certain applications, the corrosion resistance as well as the adhesive strength of the layers on the surfaces are formed on the light metal surfaces. Above all, the process shall be able to be used in industrial mass production. It shall be able to be easily monitored for this, so that continuous analyses and the continuous addition of chemicals to the bath composition are not necessary. In addition, the properties of the layers that can be deposited according to the process shall be within a narrow tolerance range without the need for a complicated monitoring and control technique for this. The process shall rather have the greatest possible potential for automation. In particular, the process shall also make it possible to deposit such functional layers with a uniform thickness on cylinder faces of internal combustion engines in a reproducible manner.

It was found that iron layers deposited by electroplating possess good functional properties as functional layers on light metals. Functional layers containing iron are ideally suitable for meeting the requirements imposed on cylinder faces of internal combustion engines and of other parts greatly subjected to wear, such as parts of high-pressure injection systems for internal combustion engines. However, the problem is in this case basically that the available deposition baths lack the necessary suitability for being used in an industrial production process. In particular, the coating parameters, e.g., the composition of the bath, must be able to be easily monitored and to be kept constant within narrow limits over a rather long period of time. This is not possible in the prior-art processes. In addition, all electrolytic metallization processes have the drawback that the deposited metal layers cannot be deposited with constant layer thickness without problems on complex metal parts. In an industrial manufacturing process, these problems lead to the impossibility of reproducibly maintaining the properties of the layer, which are determined to a considerable extent by the bath composition and the thickness of the layer formed, so that the quality of the end product cannot be maintained within the narrow range required. Only extremely slight variations in quality can be tolerated especially in the case of the coating of cylinder faces and other components in the automotive industry, for which high requirements are imposed on protection against wear.

BRIEF DESCRIPTION OF THE DRAWING FIGURE

FIG. 1 is a schematic view of one embodiment of an electrochemical arrangement for depositing iron on surfaces of an internal combustion engine.

DETAILED DECRIPTION OF THE PREFERRED EMBODIMENTS

The method according to the present invention makes it possible to use the process on an industrial scale, which is a very important requirement, and the properties of the functional layers that can be deposited according to this process can be maintained within narrow tolerances without problems. Iron is deposited electrolytically for this purpose on the surfaces of workpieces from an aqueous deposition bath containing Fe(II) compounds using dimensionally stable anodes that are insoluble (inert) in the deposition bath. Fe(II) salts, e.g., $FeSO_4$ or $FeCl_2$, are preferably used as Fe(II) compounds. It is also possible, in principle, to use Fe(III) compounds. Instead of an iron anode, which is usually used to deposit iron and is soluble in the deposition bath, an insoluble, inert anode, e.g., an activated titanium anode, an activated special steel anode, a graphite anode or a lead anode is used in the process according to the present invention. The activation of the titanium and special steel anodes is achieved, e.g., by plating these electrodes with platinum. The overvoltage of the electrochemical reactions taking place on these electrodes is lowered as a result.

It is achieved due to the use of dimensionally stable anodes instead of the iron anodes used usually, which dissolve during the deposition process and whose geometric dimensions and shape thus change continually, that the deposition process can be carried out without interruption. By contrast, it is not possible to set sufficiently reproducible conditions during the coating of, e.g., the faces of cylinders of internal combustion engines with soluble iron anodes, so that layers of nonuniform thickness will be formed on the cylinder walls and there will be especially great differences in thickness from one component to the next. Since the geometric conditions must be maintained accurately in the cylinders of internal combustion engines, this result is not tolerable. By contrast, it is guaranteed by the use of the dimensionally stable anodes that the geometry of the anodes will not change during the coating process, so that the geometric relationships once set between the anodes and the surfaces to be coated will remain constant and layers with an extremely uniform and constant layer thickness distribution will be formed. In addition, measures must be taken in the case of the use of soluble anodes to separate the anode sludge formed. By contrast, no anode sludge is generated with the use of inert anodes.

It is possible to use, e.g., rod-shaped dimensionally stable anodes, which are sunk concentrically into the cylinders in the axial direction, to coat the cylinder faces of internal combustion engines. Due to the rotational symmetry of the bar anode/cylinder pair, a constant electric field density is generated in the cylinder space in this case during the electrolytic deposition, so that the cathodic current density prevailing on the cylinder walls is identical at all points. As a result, it is possible to deposit a functional layer of a highly uniform thickness. Since, moreover, the geometry of the anode does not change, these conditions also remain constant over a rather long period of time. A highly uniform layer thickness is also obtained on other rotationally symmetrical parts as well, which are used, e.g., in the automotive industry. For example, valve parts and nozzles of high-pressure injection systems for motor vehicles can be coated uniformly with highly wear-resistant layers on the outer side if a suitable geometry of the pair comprising the workpiece to be coated and the anode is selected.

The process can also be easily automated by sinking the anodes to an exactly defined depth into the cylinders with a device suitable for this purpose and filling the deposition bath into the cylinder. After the conclusion of the electroplating operation on a cylinder or an engine block with a plurality of cylinders, the electroplating device can be automatically and reproducibly displaced to a next cylinder or engine block. The deposition solution is removed from the coated cylinder after the conclusion of the coating operation. Other solutions are subsequently filled into the cavity in order to rinse and aftertreat the cylinder walls. The cylinder walls may also be pretreated in advance in the same manner by filling pretreating solutions and rinsing liquids into the cylinders.

The deposited iron layers adhere to the light metal surfaces extraordinarily well. It is remarkable that this can also be achieved without complicated pretreatment, e.g., by a zincate treatment, which must be usually used, e.g., to nickel-plate aluminum surfaces. The coating process can therefore be carried out in a simple manner.

Due to the use of insoluble anodes, which is expedient per se, the concentration of the iron compounds, namely, (Fe(II) compounds and Fe(III) compounds), in the deposition bath can be maintained at a constant value with considerable effort only. This is due, among other things, to the fact that the Fe(II) compounds are depleted in the solution during the deposition of iron, and the necessity to set a constant concentration of these compounds without complicated monitoring by continuous analyses and the corresponding addition of the Fe(II) compounds leads to an unacceptably great effort in conducting the process and to considerable problems in industrial practice, because the compounds consumed during the deposition are not supplied into the bath in an anodic counterreaction. Especially when workpieces with different surfaces are to be coated, the cathodic current density and consequently the cathodic current efficiency change continually, so that it is not possible to set constant conditions. Moreover, it is necessary for economic reasons in industrial mass production to select the highest possible current density. As a result, the range of electrolyte decomposition is reached while hydrogen is released at the cathode, which not only leads to a reduction in the relative (percentage) current efficiency, but also makes it difficult at the same time to conduct the bath because variations in the current efficiency must be taken into account when adding more Fe(II) compounds.

In addition, it is required, e.g., for coating the cylinder walls of internal combustion engines, that the deposition bath be filled into the cylinders and that it remain there during the deposition. Only relatively small volumes of deposition bath are kept in a bath reservoir with this production technique, so that a certain turnover of the quantity of the Fe(II) compounds becomes all the more noticeable as a change in concentration.

If insoluble (inert) anodes are used for the electrolytic metal deposition process, it is possible, in principle, to replace the Fe(II) compounds consumed during the deposition by adding them to the bath in the form of solutions of these compounds or in the form of solid salts. This leads to the problems described above. In addition, further obstacles arise to carrying out the process: With the continuous addition of Fe(II) solutions, the bath volume would continuously increase in an unacceptable manner, because the iron salts used have only a limited solubility, so that parts of the bath would have to be continually discarded. This is not acceptable for economic and ecological reasons. The addition of solid iron salts to the deposition baths is not a solution here, either, because such a replacement method is known to be always difficult and technically complicated, so that it cannot come into consideration, either. Furthermore, the formation of Fe(III) compounds formed at the insoluble anode should be considered to be a parasitic phenomenon at the current state of the art, since the Fe(III) compounds must again be reduced cathodically into Fe(II) compounds. The current efficiency of the iron deposition from the deposition bath decreases as a result.

A step according to the present invention in the process being claimed is therefore based essentially on the problem that the Fe(II) compounds are consumed by the deposition of iron and that fluctuating concentrations of the bath components, especially the Fe(II) compounds, are not tolerable.

This problem is solved by forming the Fe(II) compounds by bringing the Fe(III) compounds formed at the anodes during their oxidation into contact with iron parts and reacting them with these chemically, while the iron parts dissolve. By appropriately selecting larger or smaller iron parts and by properly setting the flow conditions during the contacting of the deposition bath with the iron parts, the dissolution of the iron parts, accompanied by the formation of hydrogen by the acid deposition electrolyte, is also extensively suppressed, so that the formation of iron(II) compounds depends essentially on the concentration of the Fe(III) compounds in the deposition bath.

Compared with processes in which the Fe(II) compounds are added in the form of dissolved salts to the deposition bath, the process being claimed can be carried out in an extremely elegant and simple manner if insoluble anodes are used, because the Fe(II) compounds are always formed essentially only to the extent to which Fe(III) compounds are formed at the anode by the electrochemical oxidation reaction. The content of the Fe(II) compounds thus becomes established at the desired value quasi automatically. If suitable process parameters were set in advance, values above this value are ruled out practically just as much as values below this value. An error-prone monitoring and conduct of the bath by continuous analyses and the addition with respect to the Fe(II) concentration, as is necessary in the case of the addition of solutions of the Fe(II) compounds or of their solid salts, is eliminated as a result. Extensive constancy of the concentration of the Fe(II) compounds in the bath is therefore achieved due to this measure alone, so that it becomes unnecessary to continuously add iron salts. The iron parts are preferably accommodated in a separate container. The deposition bath is circulated between the treatment section, in which the surfaces to be coated and the anode are located, and this separate container. The bath solution is preferably sent, e.g., pumped into the separate container immediately after contact with the anode, at which Fe(III) compounds are formed by electrochemical reaction, in order to prevent the Fe(III) compounds from coming into contact with the cathode surface. The Fe(III) compounds would otherwise be parasitically reduced at this point into Fe(II) compounds, so that the cathodic current efficiency would decrease even further. $Fe^{3+}$ ions are consumed in the separate container according to the following reaction equation, while $Fe^{2+}$ ions are formed:

$$2Fe^{3+}+Fe^{0}\rightarrow 3Fe^{2+} \text{ (dissolution reaction on the iron parts) (1)}$$

As a result, it is necessary to add Fe(II) compounds. It is completely sufficient according to the present invention to bring the bath solution into contact with a sufficiently large iron surface. Iron granules, iron chips or iron pellets are preferably used in the separate container. The size and shape of the separate container and the selection of the quantity, type and size of the iron parts can be optimized according to the known principles of chemical technology.

However, it turned out that the composition of the deposition solution does nevertheless change during prolonged operation. This was observed especially when the process was carried out at a relatively high cathodic current density. Such a high anodic current density, e.g., in the range of 10 $A/dm^2$ to 100 $A/dm^2$, is imperative for the industrial use of the process especially in mass production for economic reasons. The change in the composition of the bath (increase in the iron concentration) was able to be attributed to the low cathodic current efficiency of the iron deposition under these conditions, while the anodic current efficiency is not affected hereby, in principle. Since hydrogen is also released during the deposition at the cathodic surface of the workpiece, the content of the Fe(II) compounds increases continuously during the electrolysis operation, because a larger quantity of the Fe(II) compounds is oxidized into Fe(II) compounds under these conditions, so that the quantity of metallic iron dissolved is also larger than the quantity deposited cathodically on the workpieces. Even though it would be possible to solve this problem by separating iron(II) compounds formed in an excess quantity, e.g., by crystallizing these compounds in another separate container by cooling the solution, this method is complicated and requires a considerable amount of additional energy for cooling and reheating the bath flowing through the additional separate container. In addition, a complicated monitoring and control technique becomes necessary to separate exactly the quantity of Fe(II) compounds formed in excess.

It was possible to solve this additional problem in a simple manner by correspondingly reducing the anodic current efficiency. Because of the technically elegant and simple feasibility, a time-dependent change in the active anode surface is preferably used for this purpose. The anode surface is reduced for this purpose at least temporarily to the extent that the anodic current efficiency corresponds in a time-averaged manner to the cathodic current efficiency for the iron deposition. The anodic current efficiency is increased for this at least temporarily to the extent that the anodic current efficiency for the oxidation of the Fe(II) compounds into Fe(III) compounds becomes exactly as high at least in a time-averaged manner as the cathodic current efficiency for the iron deposition from the deposition bath. Even though hydrogen is also generated on the workpieces to be coated in the deposition bath under these conditions, oxygen is also formed from the aqueous deposition bath in an equimolar quantity at the anode under these conditions, so that the balance of formation of the Fe(II) compounds is thus constant in the overall system. Only the electrolysis of water takes place as a secondary reaction due to the two partial electrochemical processes on the cathodic light metal surface and the anode surface.

Two approaches are possible to accomplish this:

In a preferred variant of the process, the anodic current density is set at the desired value by selecting the anode surface. This can be achieved in a simple manner by suitably dimensioning the anode.

When the above-described alternative is used, the geometry of the anode is selected for a certain cathodic current density. If components with different workpiece surfaces are used for the processing or if the current density is varied, the cathodic current density will change as well, so that an anode with likewise adapted dimensions must be used for adaptation to these changed conditions. However, this is complicated and cannot be readily carried out in an industrial manufacturing process requiring flexibility.

Part of the anode surface is therefore switched intermittently on and off in another preferred embodiment variant of the present invention, the ratio of the time average of the off time to the on time being set at a value that is so high that the anodic current efficiency for the oxidation of the Fe(II) compounds into Fe(III) compounds is exactly as high in a time-averaged manner as the cathodic current efficiency for the deposition of iron from the deposition bath. The anodic current density is temporarily increased in this case in order to lower the anodic current efficiency and to maintain in this manner the time-averaged balance of formation of the Fe(II) compounds in the overall system. Compared with the above-described first variant, this alternative offers the additional advantage that a stable balance of formation can be set for the Fe(II) compounds, regardless of the cathodic current density selected, by adapting only the ratio of the off time to the on time to the changed conditions.

The above-mentioned measures also make it, of course, possible to correct the iron content electrochemically, at any time.

Due to the anodic current efficiency being always set at the desired value, the rate of production of Fe(III) compounds into Fe(II) compounds is adapted to the particular conditions, so that even though Fe(II) compounds are consumed, on the one hand, on the surface of the workpiece due to cathodic reaction at the stationary equilibrium, the Fe(II) compounds are formed due to the dissolution of the iron parts by the reaction of the said iron parts with the Fe(III) compounds and, finally, Fe(II) compounds are consumed by the anode reaction, which is adapted to the changing conditions:

$2Fe^{3+}+Fe^{0}\rightarrow 3Fe^{2+}$ (dissolution reaction on the iron parts) (1)

$Fe^{2+}+2e^{-}\rightarrow Fe^{0}$ (cathode reaction on the workpiece surface) (2)

$Fe^{3+}+e^{-}\rightarrow Fe^{2+}$ (anode reaction) (3)

The concentrations of the Fe(II) and Fe(III) compounds can therefore be set at any time by controlling the anodic current efficiency according to the present invention in a very simple manner.

Surrounding the anode with a diaphragm is also a preferred procedure for controlling (lowering) the anodic current efficiency for the oxidation of the Fe(II) compounds into the Fe(III) compounds. A fabric permeable to liquids may be used as the diaphragm. As a result, at least the convective transport of Fe(II) compounds to the anode is prevented or at least greatly hindered. By reducing the concentration of the Fe(II) compounds in the anode space enclosed by the diaphragm by the anode reaction to a very low value or even to zero, the overvoltage of the anodic partial reaction increases greatly (increase in the concentration overvoltage), so that oxygen is alternatively released at the anode. The quantity of the oxygen generated at the anode is thus set based on the limiting diffusion current of the oxidation of the Fe(II) compounds.

The hardness, the wear resistance and the corrosion resistance of the layers deposited according to the above-described process can be further increased if the deposition solution additionally contains at least one compound from the group comprising hypophosphite, orthophosphite and molybdenum compounds and tungsten compounds. The salts, e.g., alkali salts ($NaHPO_2$, $KHPO_2$, $Na_2HPO_3$, $K_2HPO_3$, etc.) and their acids ($H_2PO_2$, $H_3PO_3$) may be used as the hypophosphite and orthophosphite compounds. Especially alkali molybdates can be used as molybdenum compounds and especially alkali tungstates can be used as tungsten compounds, but other molybdates and tungstates can be used as well.

Alloys of iron with phosphorus, molybdenum and/or tungsten are formed in the presence of the said compounds in the deposition bath. Very hard functional layers, which additionally have a high wear resistance, are formed especially due to the addition of the hypophosphite and orthophosphite compounds. The layers that can be prepared with the use of molybdenum and/or tungsten compounds in the deposition bath likewise have great hardness and very good corrosion resistance. The tribological properties of the layers obtained with the above-mentioned bath additives are also very good: Tribological tests showed no tears from the layers applied to the light metal surfaces. The layers that can be prepared with these additives are especially suitable for coating cylinder faces of internal combustion engines because of their hardness and wear resistance. The hypophosphite and orthophosphite compounds, which are sometimes labile with respect to oxidation, are interestingly oxidizing at the inert, dimensionally stable anode. Their applicability was therefore not predictable under the conditions selected here with an inert anode.

Extremely wear- and corrosion-resistant surfaces are obtained especially when hypophosphite and orthophosphite compounds are used to deposit the layers. It was found that iron-phosphorus layers, which contain phosphorus in an amount of 0.5 wt. % to 3 wt. % and preferably about 1 wt. %, are deposited in this case. These layers were examined according to physical methods (scanning electron microscopy, X-ray diffraction studies). It was determined in these examinations that the iron-phosphorus alloys prepared are nanocrystalline, i.e., they consist of crystallites of a size of at most about 500 nm and preferably at most 200 nm. This was determined by scanning electron microscopic studies according to the backscattering method. Even though X-ray structural analyses carried out with the use of a Guinier diffractometer (Cu—$K_\alpha$ radiation) showed normal reflections of the cubic space-centered iron structure, crystal sizes of less than 500 nm were found in the scanning electron microscopic studies, in which the crystal size was to be determined at a 5,000× magnification.

The aqueous deposition bath preferably contains the components of the bath in the dissolved form. Besides the Fe(II) compounds mentioned above and the hypophosphite, orthophoshite, molybdenum and/or tungsten compounds that may be optionally added to the bath as additives, the bath may also contain acids, e.g., inorganic acids, preferably hydrochloric acid, sulfuric acid, fluoroboric acid and/or perchloric acid. Especially sulfonic acids, such as methanesulfonic acid, amidosulfonic acid, formic acid and acetic acid may be considered for use as organic acids. In addition, the bath may contain complexing agents for iron to affect the deposition potential, as well as further additives, such as wetting agents, to affect the surface tension of the bath, organic inhibitors to affect the deposition properties, other additives affecting the deposition or additional additives. Such additives have been generally known from the deposition of metals by electroplating.

The light metal surfaces are first pretreated prior to the coating with the deposition bath. For example, they may be cleaned for this purpose with a solution containing wetting agent and optionally an acid or base. The surfaces are then preferably pickled in order to increase the adhesion of the functional layer on the surfaces. For example, an alkaline pickle consisting of an aqueous solution of NaOH may be used for this purpose. The surfaces are subsequently preferably treated with a solution with which iron can be deposited by means of cementing on the light metal surfaces. For example, a solution of $FeCl_3$ in aqueous hydrochloric acid is used for this purpose.

The functional layer is then deposited from the deposition bath. A direct current process is used, in general, for this purpose. However, a pulsed current process, in which the surface of the workpiece is briefly subjected to a cathodic current pulse and then either to an electroplating pause or an anodic current pulse. Electroplating pauses may also be provided between the cathodic and anodic current pulses. The uniformity of the metal deposition may be possibly increased further with this process. The temperature of the deposition bath is optimized depending on the bath composition. A temperature above room temperature, e.g., 60° C., proved to be advantageous. The temperature of the bath solution in the separate container containing the iron parts should be just as high as the temperature in the deposition container for economic reasons.

The light metal surfaces are rinsed between the individual process steps and subsequent to the metal deposition. To coat cylinder faces of internal combustion engines, the individual treating liquids can be filled into the cylinder cavities. The cavities are connected for this purpose via suitable pump systems to the separate containers containing the iron parts and additional reservoirs, in which the individual treating liquids are located. For preparation and metal deposition on the faces, the treating liquids and the rinsing water are pumped one after another into the cavities according to an exactly predetermined time schedule, allowed to remain in the said cavities for a certain period of time and removed after the end of the particular treatment. In addition, the other necessary process conditions are set in the cavities, e.g., a suitable forced convection in the treating liquids, rinsing of the liquids with oxygen or air and setting of the desired treatment temperatures. Following this procedure, the faces can be coated with the functional layer in a simple and automated manner.

The present invention will be explained in greater detail by the following examples:

EXAMPLE 1

Determination of the Mass Balance During the Chemical Dissolution of Iron Parts with Fe(III) Compounds Two bath solutions were used:

A) 250 g/L of $Fe_2(SO_4)_3.5H_2O$
40 g/L of $FeCl_3.6H_2O$

B) 250 g/L of $Fe_2(SO_4)_3.5H_2O$
40 g/L of $FeCl_3.6H_2O$
15 g/L of $Na_2HPO_3.5H_2O$

The experiments with the two solutions A and B were carried out in a 200-mL beaker. Ten g of iron chips each with a mean particle size of about 1 mm were filled into the beakers, so that the chips had a total area of 35 $cm^2$. The temperature of the solutions was 50° C. The solutions were stirred vigorously.

A complete change in color from brown (presence of $Fe^{3+}$) to green (presence of $Fe^{2+}$) was able to be observed with both solutions within 30 minutes. It was possible to conclude from this observation that $Fe^{3+}$ had been reduced nearly completely into $Fe^{2+}$. Thus, a rate of decomposition of 12.3 mg/minute was obtained for $Fe^{3+}$ under the conditions selected.

By reweighing the iron chips and analyzing the solution formed by atomic absorption spectrometry, it was possible to verify that the conversions for Fe, $Fe^{2+}$ and $Fe^{3+}$ correspond to the quantities to be expected from the Reaction Equation (1) shown: The batch of the solutions contained 13 g of $Fe^{3+}$. After the chemical reaction had been carried out, the iron content in the solution was approx. 20 g. This result was obtained in the same way for both solutions A and B.

EXAMPLE 2

The rate of formation of $Fe^{3+}$ was determined as a function of the cathodic current density (cathodic current efficiency of 60%) during the electrolysis of the above-described solutions A and B at a titanium expanded metal anode, which had been coated with a conductive precious metal mixed oxide:

| Current density [A/dm$^2$] | Rate of formation of $Fe^{3+}$ [g/minute] |
|---|---|
| 30 | 3.95 |
| 20 | 2.60 |
| 10 | 1.32 |

Using the rates of decomposition determined for $Fe^{3+}$ in Example 1, it was possible to determine the necessary effective area of the iron parts (chips or granules) for the reduction of $Fe^{3+}$ and thus for the regeneration of the $Fe^{2+}$ concentration in the bath solution as a function of the current density:

| Current density [A/dm$^2$] | Necessary area [cm$^2$] |
|---|---|
| 30 | 321 |
| 20 | 211 |
| 10 | 107 |

By using iron granules, it was thus possible to reduce the $Fe^{3+}$ concentration in the bath solution to nearly zero and thus to regenerate the $Fe^{2+}$ ions. According to the estimates performed here concerning the iron balance in the solution according to Reaction Equation (1), it was also possible to perform the regeneration process while maintaining industrially practical conditions.

EXAMPLE 3

A light metal sheet consisting of AlSi10 was treated in the following manner for the subsequent coating:

1. Pretreatment (iron coating by means of cementing):

| Step | Bath | Temperature [° C.] | Treatment time [sec] |
|---|---|---|---|
| 1. Degreasing | Solution containing wetting agent | 60 | 300–600 |
| 2. Pickling | NaOH (33 wt. %) | 60 | 30 |
| 3. Rinsing | Tap water | Room temperature | 10 |
| 4. Iron pickle | 50 g/L $FeCl_3$ 50 g/L HCl | 70 | 30 |
| 5. Rinsing | Tap water | Room temperature | 10 |

Steps 2 through 5 were repeated once.

2. The sheet metal was subsequently treated with the coating solution. The composition of this solution was as follows:

400 g of $FeSO_4 \cdot 7H_2O$ 80 g of $FeCl_2 \cdot 4H_2O$ 15 g of $Na_2HPO_3 \cdot 5H_2O$ in 1 L of deionized water.

The deposition was carried out under the following conditions:

| | |
|---|---|
| Current density | 10–20 A/dm$^2$ |
| Bath temperature | 60° C. |
| pH value | 1 |
| Pumping rate | 21 mL/sec |
| Bath volume | 5 L |
| Soluble iron anode | |

The layers obtained were characterized with respect to their composition. The following results were obtained:

| Fe content [%] | P content [%] | C content [%] | O content [%] |
|---|---|---|---|
| 92–95 | 0.9–1.2 | 2–4 | 2.5–3.5 |

In addition, stresses in the layer were determined with a spiral contractometer. The layers showed tensile stress (deflection about 290°). The values obtained corresponded to those of the nickel layers deposited electrolytically and the nickel-phosphorus layers deposited in a current-free manner.

Furthermore, the tribological properties of the iron layers were determined:

The wear coefficient [mm$^3$/Nm] was first measured. A piston ring was rubbed for this purpose against the inner surface of a coated cylinder covered with an oil film, and the abrasion of the iron layer on the piston ring and the corresponding abrasion on the cylinder wall were determined. The following test conditions were set for this:

| | |
|---|---|
| Velocity of the ring | v = 0.3 m/sec |
| Normal force on the cylinder wall | $F_N$ = 50 N |
| Oil temperature | T = 170° C. |
| Glide path | s = 24 km |

The wear coefficient $k_v$ in [mm$^3$/Nm], i.e., the volume removed from the piston ring and the cylinder surface, was determined. Furthermore, the coefficient of friction $f_a$ was also determined as the coefficient of the torque and the normal force $F_N$ applied.

The wear coefficients $k_v$ [mm$^3$/Nm] determined equaled:

| | Iron layer | Gray cast iron |
|---|---|---|
| On the piston ring | $1 \cdot 10^{-8}$–$1 \cdot 10^{-9}$ | $1 \cdot 10^{-8}$–$1 \cdot 10^{-10}$ |
| On the cylinder wall | $2 \cdot 10^{-6}$–$5 \cdot 10^{-7}$ | $2 \cdot 10^{-6}$–$1 \cdot 10^{-8}$ |

The comparison values in the right-hand column show the values for gray cast iron instead of the iron coating.

The coefficients of friction $f_a$ determined equaled:

| | Iron layer | Gray cast iron |
|---|---|---|
| At the beginning | 0.14 ± 0.02 | 0.12 ± 0.02 |
| At the end | 0.12 ± 0.02 | 0.12 ± 0.03 |

The comparison values in the right-hand column show the values obtained for gray cast iron instead of the iron coating.

Furthermore, it was observed that no adhesive wear occurred, that the homogeneity of the layer was good, and that no change occurred in the surface during the experiment due to the build-up or removal of intermediate layers. No flaking of the iron layer was observed. Moreover, no significant abrasion of material occurred on the piston ring. Only roughness peaks were removed on the piston ring.

FIG. 1 shows a schematic view of a preferred electrochemical arrangement for depositing iron on the wall surfaces of cylinders of internal combustion engines. The interior space 2 of a cylinder 1 consisting of an aluminum alloy is filled with electrolyte liquid to the level 3. An anode 4 made of titanium, which is coated with ruthenium oxide, is sunk concentrically into the interior space 2. The anode 4 is surrounded by a diaphragm 5, which is resistant to the electrolyte liquid and consists, e.g., of polypropylene. The interior space 2 is optionally closed with a cover (not shown). The cylinder 1 is, furthermore, connected to the negative pole via a supply line 6 and the anode 4 is connected to the positive pole of a power source (not shown) via a supply line 7.

What is claimed is:

1. Process for applying a metal layer comprising iron to surfaces of light metals, comprising: electrolytically depositing iron from an aqueous deposition bath containing Fe(II) compounds on the surfaces using dimensionally stable anodes insoluble in the deposition bath, wherein the Fe(II) compounds are formed in a reaction of Fe(III) compounds formed during the oxidation of the Fe(II) compounds at the anodes with iron parts and that the current density on the anode surfaces is increased at least temporarily to the extent that the anodic current efficiency becomes exactly as high, at least in a time-averaged manner, for the oxidation of the Fe(II) compounds into the Fe(III) compounds as the cathodic current efficiency for the deposition of iron from the deposition bath.

2. Process in accordance with claim 1, characterized in that part of an anode surface is switched on and off intermittently, wherein the ratio of the off time to the on time is set in a time average to a value that is so high that the anodic current efficiency for the oxidation of the Fe(II) compounds into the Fe(III) compounds is exactly as high in the time-averaged manner as the cathodic current efficiency for the deposition of iron from the deposition bath.

3. Process in accordance with claim 2, characterized in that a diaphragm surrounding an anode is provided.

4. Process in accordance with claim 2, characterized in that the deposition bath additionally contains at least one compound selected from the group consisting of hypophosphite, orthophosphite, molybdenum and tungsten compounds.

5. Process in accordance with claim 2, characterized in that the surfaces of light metals to which said metal layer comprising iron is applied is selected from the group consisting of aluminum, magnesium and their alloys.

6. Process in accordance with claim 1, characterized in that the anodic current density is set by dimensioning an anode to have an anode surface corresponding with the desired value of the current density by selecting the anode surface.

7. Process in accordance with claim 6, characterized in that a diaphragm surrounding an anode is provided.

8. Process in accordance with claim 6, characterized in that the deposition bath additionally contains at least one compound selected from the group consisting of hypophosphite, orthophosphite, molybdenum and tungsten compounds.

9. Process in accordance with claim 6, characterized in that the surfaces of light metals to which said metal layer comprising iron is applied is selected from the group consisting of aluminum, magnesium and their alloys.

10. Process in accordance with claim 1, characterized in that a diaphragm surrounding an anode is provided.

11. Process in accordance with claim 10, characterized in that the deposition bath additionally contains at least one compound selected from the group consisting of hypophosphite, orthophosphite, molybdenum and tungsten compounds.

12. Process in accordance with claim 10, characterized in that the surfaces of light metals to which said metal layer comprising iron is applied is selected from the group consisting of aluminum, magnesium and their alloys.

13. Process in accordance with claim 1, characterized in that the deposition bath additionally contains at least one compound selected from the group consisting of hypophosphite, orthophosphite, molybdenum and tungsten compounds.

14. Process in accordance with claim 13, characterized in that the surfaces of light metals to which said metal layer comprising iron is applied is selected from the group consisting of aluminum, magnesium and their alloys.

15. Process in accordance with claim 1, characterized in that the surfaces of light metals to which said metal layer comprising iron is applied is selected from the group consisting of aluminum, magnesium and their alloys.

16. A process for applying a metal layer comprising iron to surfaces of light metals and for coating cylinder faces of internal combustion engines and of rotationally symmetrical parts to impart wear resistance properties to the coated surface, the process including:

depositing iron electrolytically from an aqueous deposition bath containing Fe(II) compounds on the surfaces using dimensionally stable anodes insoluble in the deposition bath, wherein the Fe(II) compounds are formed in a reaction of Fe(III) compounds formed during the oxidation of the Fe(II) compounds at the anodes with iron parts and that the current density on an anode surface is increased at least temporarily to the extent that the anodic current efficiency becomes exactly as high, at least in a time-averaged manner, for the oxidation of the Fe(II) compounds into the Fe(III) compounds as the cathodic current efficiency for the deposition of iron from the deposition bath.

17. The process of claim 16, characterized in that part of the anode surface is switched on and off intermittently, wherein the ratio of the off time to the on time is set in a time average to a value that is so high that the anodic current efficiency for the oxidation of the Fe(II) compounds into the Fe(III) compounds is exactly as high in the time-averaged manner as the cathodic current efficiency for the deposition of iron from the deposition bath.

18. The process of claim 16, characterized in that the surfaces of light metals to which said metal layer comprising iron is applied is selected from the group consisting of aluminum, magnesium and their alloys.

* * * * *